US009395662B2

(12) United States Patent
Sato

(10) Patent No.: US 9,395,662 B2
(45) Date of Patent: Jul. 19, 2016

(54) IMAGE FORMING APPARATUS WITH HEATING CONTROL UNIT

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/663,194

(22) Filed: Mar. 19, 2015

(65) Prior Publication Data

US 2015/0268601 A1 Sep. 24, 2015

(30) Foreign Application Priority Data

Mar. 20, 2014 (JP) ..... 2014-058930

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2039; G03G 15/2078
See application file for complete search history.

(56) References Cited

U.S. PATENT DOCUMENTS 5,708,920 A * 1/1998 Ohnishi ..... G03G 15/2039 399/69
5,862,436 A * 1/1999 Ishizawa ..... G03G 15/2042 219/216
5,961,864 A * 10/1999 Nakajima ..... G03G 15/2053 219/216
6,385,410 B1 * 5/2002 Hanyu ..... G03G 15/2064 399/337
6,539,185 B2 * 3/2003 Hanyu ..... G03G 15/2039 219/216
7,949,274 B2 * 5/2011 Furuyama ..... G03G 15/2039 399/45
9,098,028 B2 * 8/2015 Takatsuka
2004/0009000 A1 * 1/2004 Mizuno ..... 399/45
2004/0131374 A1 * 7/2004 Sakai ..... G03G 15/2039 399/68
2005/0276625 A1 * 12/2005 Cho ..... G03G 15/205 399/69
2007/0196120 A1 * 8/2007 Maeda ..... G03G 15/2039 399/69
2008/0181640 A1 * 7/2008 Hasegawa ..... G03G 15/5004 399/69

FOREIGN PATENT DOCUMENTS

JP 2005215053 A 8/2005

* cited by examiner

*Primary Examiner* — G. M. Hyder
(74) *Attorney, Agent, or Firm* — Muncy, Geissler, Olds & Lowe, P.C.

(57) ABSTRACT

An image forming apparatus includes a fuser unit that heats a medium and fuses a developer on the medium, a plurality of heating units that heat the fuser unit, a temperature detection unit that detects a temperature of the fuser unit, a heating control unit that controls a heating amount of the heating units based on the temperature detected by the temperature detection unit, and a selection unit that selects heating units to start heating from the plurality of heating units. The heating control unit sets such that, among the heating units selected by the selection unit, a heating amount of one of the heating units becomes larger than a heating amount of the others of the heating units.

19 Claims, 10 Drawing Sheets

IMAGE FORMING APPARATUS WITH HEATING CONTROL UNIT

CROSS REFERENCE

The present application is related to, claims priority from and incorporates by reference Japanese Patent Application No. 2014-058930, filed on Mar. 20, 2014.

TECHNICAL FIELD

The present invention relates to an image forming apparatus that includes a fuser.

BACKGROUND

A conventional image forming apparatus includes a fuser that fuses toner with heat and pressure, the toner corresponding to a print image and being transferred to a sheet. A heater contained in a heating roller of the fuser heats, a temperature detection unit detects a temperature of the heating roller, and driving of the heater is controller such that the temperature is optimum with respect to a print condition. (For example, Patent Document 1)

Patent Document 1

Japanese Laid-Open Patent Application No. 2005-215053

However, when the conventional invention is configured such that a fuser belt having a small heat capacity receives heat of a heater having a large range of temperature change, the temperature change of the fuser belt as a fuser member is excessively large and therefore a fusing error of toner as a developer may occur. The present invention has been made to solve such problem. Therefore, it is an object of the present invention to suppress the temperature change of the fuser member and suppress the occurrence of the fuser error of the developer.

An image forming apparatus disclosed in the application includes a fuser unit that heats a medium and fuses a developer on the medium, a plurality of heating units that heat the fuser unit, a temperature detection unit that detects a temperature of the fuser unit, a heating control unit that controls a heating amount of the heating units based on the temperature detected by the temperature detection unit, and a selection unit that selects heating units to start heating from the plurality of heating units. The heating control unit sets such that, among the heating units selected by the selection unit, a heating amount of one of the heating units becomes larger than a heating amount of the others of the heating units.

The present invention configured as described above is able to obtain effects of suppressing the temperature change of the fuser member and suppressing the occurrence of fusing errors of developers.

BRIEF DESCIRPTION OF THE DRAWINGS

Hereinafter, with reference to the drawings, an embodiment of an image forming apparatus of the present invention is explained.

First Embodiment

Figure 2:
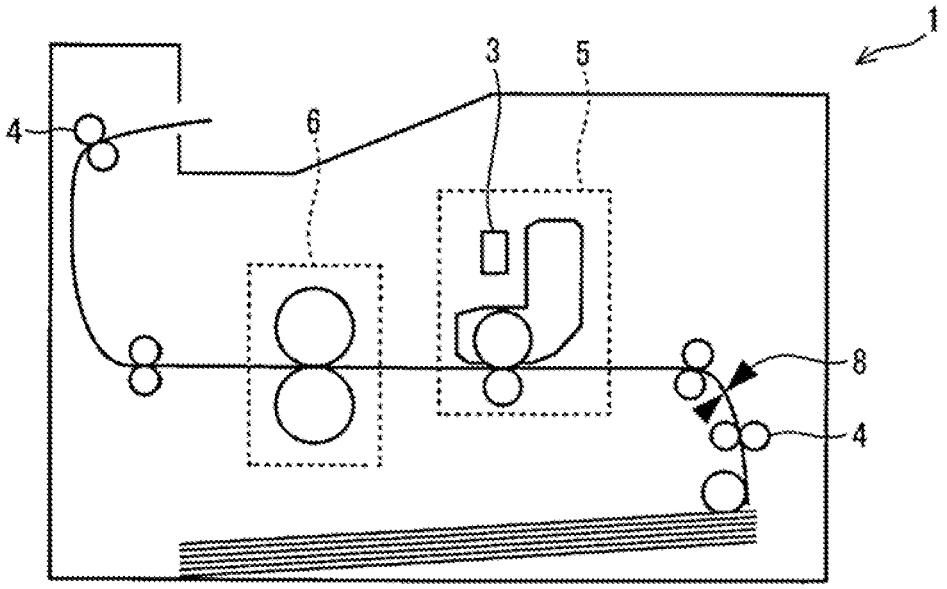
FIG. 2 is an explanatory view that shows a configuration of an image forming apparatus according to the first embodiment.

FIG. 2 is an explanatory view that shows a configuration of an image forming apparatus according to the first embodiment. In FIG. 2, an image forming apparatus 1 is configured of an electrographic system printer, for example. The image forming apparatus 1 includes a sheet carrying part 4 that carries a sheet as a medium from a sheet container part to a sheet ejection part, a writing sensor 8 that detects a position of a sheet on a sheet carrying path before image formation, the sheet carrying path on which a sheet is carried, a light emitting diode (LED) head 3 as an exposure member that exposes recording light, a toner image formation part 5 that forms toner image corresponding to the recording light as developer image on the carried sheet, and a fuser 6 (as a fuser unit) that fuses the toner image on the sheet.

In the image forming apparatus 1, from an upstream of the sheet carrying path, the writing sensor 8, the toner image forming part 5, and the fuser 6 are arranged in this order, and the LED head 3 is arranged adjacent to the toner image forming part 5. In the image forming apparatus 1, upon a receipt of a print order, a sheet is carried to the toner image forming part 5 by the sheet carrying part 4 to match the timing of image formation. The LD head 3 irradiates the toner image forming part 5 with recording light corresponding to print information, and the toner image forming part 5 forms toner image on the sheet as image corresponding to the recording light used for the irradiation. When the sheet on which the toner image is formed is carried to the fuser 6 by the sheet carrying part 4, the toner image is fused on the sheet by heat from a heating member of the fuser 6 and pressure from a pressure application member thereof and the sheet is ejected to the outside of the apparatus.

Figure 1:
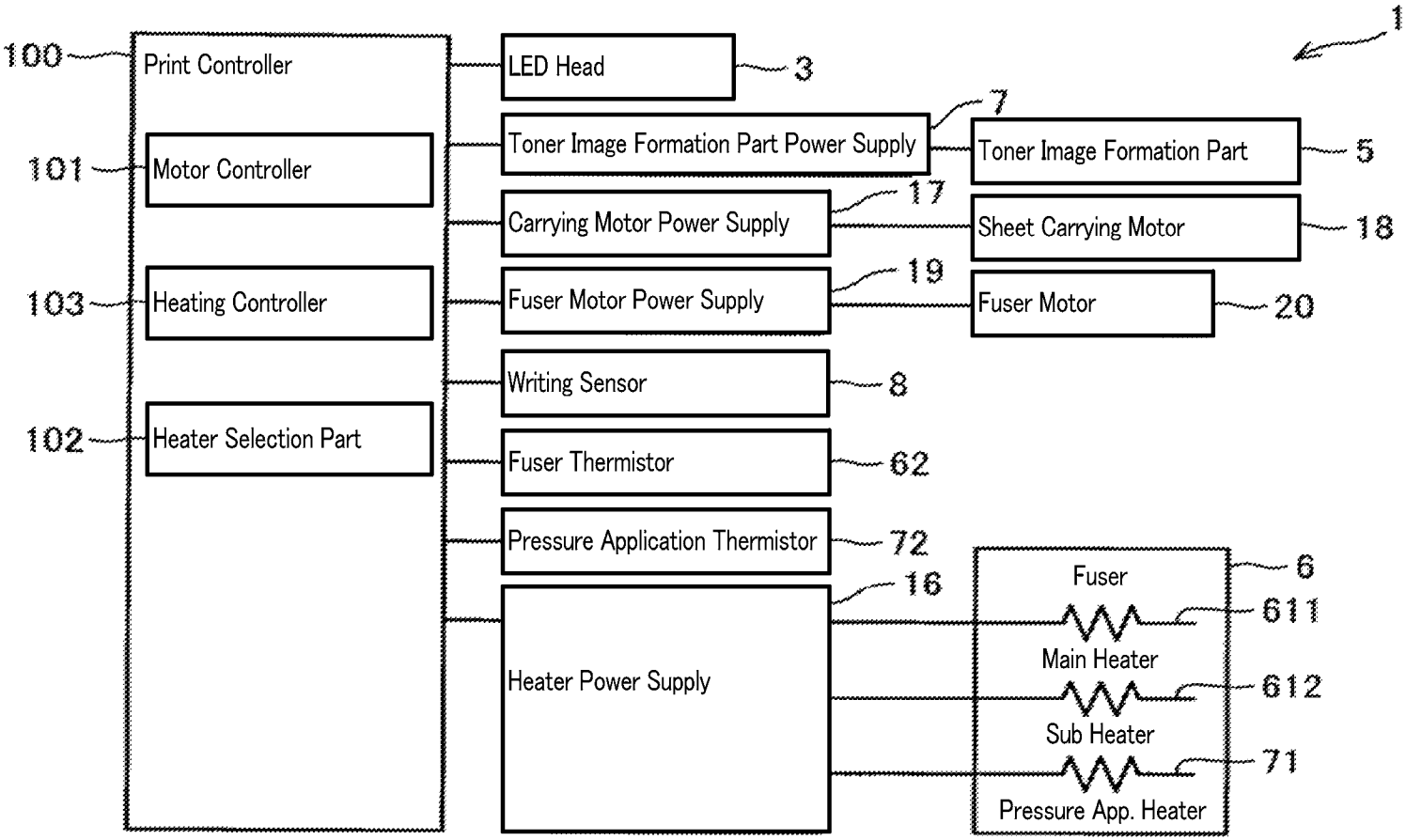
FIG. 1 is a block diagram that shows a controller configuration according to a first embodiment.

FIG. 1 is a block diagram that shows a controller configuration according to a first embodiment. In FIG. 1, the image forming apparatus 1 includes a print controller 100, the LED head 3, the toner image forming part 5, a toner image forming part power supply 7, a carrying motor power supply 17, a sheet carrying motor 18, a fuser motor power supply 19, a fuser motor 20, the writing sensor 8, a fuser thermistor 62, a pressure application thermistor 72, a heater power supply 16, and the fuser 6 that includes a main heater 611, a sub heater 612, and a pressure application heater 71. Note, the fuser thermistor 62 and the pressure application thermistor 72 are included in the fuser 6.

The print controller 100 is connected to the LED head 3, the toner image forming part power supply 7, the carrying motor power supply 17, the fuser motor power supply 19, the writing sensor 8, the fuser thermistor 62, the pressure application thermistor 72, and the heater power supply 16. Also, the toner image forming part power supply 7 is connected to the toner image forming part 5, the carrying motor power supply 17 is connected to the sheet carrying motor 18, and the fuser motor power supply 19 is connected to the fuser motor 20. Furthermore, the heater power supply 16 is connected to the main heater 611, the sub heater 612, and the pressure application heater 71 in the fuser 6.

The print controller 100 as a controlling unit controls image forming action performed by the image forming apparatus 1, includes a motor controller 101, a heater selection part 102, and a heating controller 103, and controls the entire action of the image forming apparatus 1 based on a control program (software) memorized in the memory part. A motor controller 101 as the sheet carrying controlling unit and the rotation controlling unit performs a control of sheet carrying as controlling the carrying motor power supply 17 and the sheet carrying motor 18 (the sheet carrying controlling unit), and performs a control of rotation of the fuser member as controlling the fuser motor 20 (the rotation controlling unit).

The heater selection part 102 as a selection unit selects a heater that should be used from a plurality of heaters, which are the main heater 611, the sub heater 612, and the pressure application heater 71. The heating controller 103 as a heating control unit performs a temperature control of the fuser 6 as controlling the heater power supply 16. The heating controller 103 of the present embodiment performs a temperature control of one or more of the heaters selected by the heater selection part 102 based on a temperature detected by the fuser thermistor 62. The toner image forming part power supply 7 applies voltage to the toner image forming part 5 by a control of the print controller 100.

The carrying motor power supply 17 supplies power to the sheet carrying motor 18. The sheet carrying motor 18 rotates carrying rollers that carry the sheet on the sheet carrying part 4 in FIG. 2. The fuser motor power supply 19 supplies power to the fuser motor 20. The fuser motor 20 rotates fuser members and the like of the fuser 6. The writing sensor 8 as a sheet position detection unit detects a sheet carrying position on the sheet carrying path.

The fuser thermistor 62 as a temperature detection unit detects a temperature of the fuser member in the fuser 6. Also, the pressure application thermistor 72 as a temperature detection unit detects a temperature of pressure application members. The fuser 6 includes the main heater 611 and the sub heater 612 as a plurality of heating units that heat the fuser members and the pressure application heater 71 as a heating unit that heats pressure application members. The heater power supply 16 supplies power to the main heater 611, the sub heater 612, and the pressure application heater 71.

In the present embodiment, the print controller 100 in the image forming apparatus 1 includes the heating controller 103 and the heater selection part 102. The heating controller 103 controls heating amounts of the main heater 611 and the sub heater 612 based on a temperature detected by the fuser thermistor 62. The heater selection part 102 selects one or more heaters to be heated from the main heater 611 and the sub heater 612. The heating controller 103 performs a temperature control such that a heating amount of the main heater 611, one of the selected heaters, is larger than a heating amount of the sub heater 612, the other of the selected heaters, the main heater 611 and the sub heater 612 are heaters to be selected by the heater selection part 102.

Figure 3:
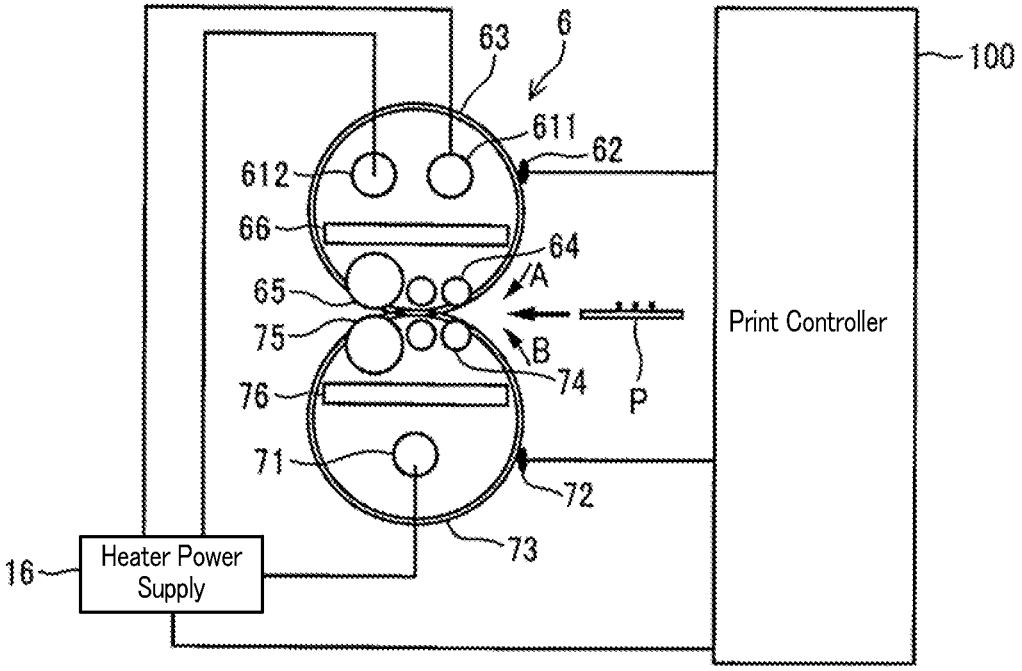
FIG. 3 is an explanatory view that shows a configuration of a fuser according to the first embodiment.

FIG. 3 is an explanatory view that shows a configuration of the fuser according to the first embodiment. In FIG. 3, the fuser 6 includes the fuser thermistor 62, a fuser belt 63, the main heater 611, the sub heater 612, an upper auxiliary pressure application roller 64, a fuser roller 65, an upper reflector 66, the pressure application heater 71, the pressure application thermistor 72, a pressure application belt 73, the lower auxiliary pressure application roller 74, a pressure application roller 75, and a lower reflector 76. The print controller 100 is connected to the fuser thermistor 62, the pressure application thermistor 72, and the heater power supply 16. Also, the heater power supply 16 is connected to the main heater 611, the sub heater 612, and the pressure application heater 71.

The fuser belt 63 as the fuser member (or rotation part) heats a sheet P as a medium and fuses toner as a developer, and applies heat to the sheet P. The main heater 611 and the sub heater 612 as heating units supplies the fuser belt 63 with heat to heat. Note, in the present embodiment, two heaters are used as the heater that supplies the fuser belt 63 with heat. However, not limited to that, three or more heaters may be used. The fuser thermistor 62 as a temperature detection unit detects a surface temperature of the fuser belt 63.

The fuser roller 65 as a rotation driving unit applies pressure to the fuser belt 63 at a nip part formed between the fuser roller 65 and the pressure application roller 75 as well as rotatably drives the fuser belt 63 in a sheet carrying direction indicated by an arrow A in FIG. 3. The upper auxiliary pressure application roller 64 forms a nip part with the lower auxiliary pressure application roller 74, and presses the fuser belt 63 to the lower auxiliary pressure application roller 74. The upper reflector 66 reflects heat generated by the main heater 611 and the sub heater 612 to concentrate the heat to the fuser belt 63.

The pressure application belt 73 as a pressure application unit rotates in a sheet carrying direction indicated by an arrow B in FIG. 3 to carry the sheet P and applies pressure to the sheet P. The pressure application heater 71 as a heating unit heats the pressure application belt 73. The pressure application thermistor 72 as a temperature detection unit detects a surface temperature of the pressure application belt 73. The pressure application roller 75 forms a nip part with the fuser roller 65, and applies pressure to the pressure application belt 73 at the nip part.

The lower auxiliary pressure application roller 74 forms a nip part with the upper auxiliary pressure application roller 64, and presses the pressure application belt 73 to the lower auxiliary pressure application roller 74. The lower reflector 76 reflects heat generated by the pressure application heater 71 to concentrate the heat to the pressure application belt 73. The fuser belt 63 and the pressure application belt 73 are made by a material that a separation layer made of silicon rubber having a thickness of 200 μm is formed on a surface layer of a metallic base with a high heat resistance having a thickness of 50 μm. That has a small heat capacity and thermal responsiveness is preferable. Note, the base may be formed of a polyimide film having a high heat resistivity or rubber.

The fuser roller 65 and the pressure application roller 75 are respectively configured to include a core as a base configured of a metallic tube whose outer diameter is 20 mm and an elastic layer whose thickness is 1 mm made of silicon rubber that covers the core. The fuser roller 65 includes a gear (not shown), and is rotated by the gear when the fuser motor 20 shown in FIG. 1 is driven by a driving signal from the print controller 100. The pressure application roller 75 is biased by an elastic body such as a spring (not shown) in a direction to be pressed to the fuser roller 65.

Also, the pressure application roller 75 contacts the fuser roller 65 through the pressure application belt 73 and the fuser belt 63. As described above, because the pressure application roller 75 contacts the fuser roller 65 through the pressure application belt 73 and the fuser belt 63, the pressure application roller 75 is rotated by driving force transferred to the fuser roller 65 and follows the fuser roller 65.

The upper auxiliary pressure application roller 64 and the lower auxiliary pressure application roller 74 are respectively configured to include a core as a base configured of a metallic tube whose outer diameter is 12 mm and an elastic layer whose thickness is 1 mm made of silicon rubber that covers the core. The lower auxiliary pressure application roller 74 is biased by an elastic body such as a spring (not shown) in a direction to be pressed to the upper auxiliary pressure application roller 64.

The lower auxiliary pressure application roller 74 contacts the upper auxiliary pressure application roller 64 through the pressure application belt 73 and the fuser belt 63, and form a nip part with the fuser roller 65 and the pressure application roller 75, the nip part being as a contact part that contacts the sheet P. The upper reflector 66 and the lower reflector 76 are made of a metallic piece with high heat resistivity, such as an iron plate, having a thickness of 1 mm. The upper reflector 66 and the lower reflector 76 reflect heat generated by the heating units to concentrate the heat to the fuser belt 63 and the pressure application belt 73, and as the result heat efficiency as the fuser 6 is improved.

The fuser thermistor 62 and the pressure application thermistor 72 are elements whose resistance value changes with temperature. The print controller 100 detects the resistance values to detect the thermistors. A characteristic of the elements used in the present embodiment is that a resistance value decreases with the increase of temperature are used. The fuser thermistor 62 contacts the fuser belt 63 and detects a surface temperature of the fuser belt 63, and the pressure application thermistor 72 contacts the pressure application belt 73 and detects a surface temperature of the pressure application belt 73. Note, in the present embodiment, the fuser thermistor 62 contacts the fuser belt 63, and the pressure application thermistor 72 contacts the pressure application belt 73, however a non-contact configuration is also acceptable.

For the main heater 611, the sub heater 612, and the pressure application heater 71, halogen heaters and the like are used. Both ends thereof are connected to the heater power supply 16 as a voltage application unit. The heaters heat when voltage is applied by the heater power supply 16. The voltage is for example 100V, and an output of the main heater 611 is 300 W for example, an output of the sub heater 612 is 300 W for example, and an output of the pressure application heater 71 is 200 W for example. In halogen heater, filament is heated and thermal electron emits so that a heated member is heated by radiative heat transfer (radiant heat transfer), which is non-contact heat transfer. The filament is held in a glass tube, and the glass tube is filled with halogen gas to obtain a certain product life cycle.

Figure 4A:
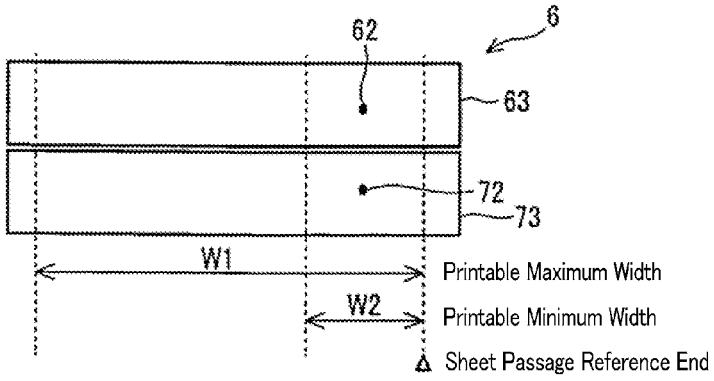
FIG. 4A and FIG. 4B are explanatory views that show distributions of heating amounts of a fuser according to the first embodiment.
Figure 4B:
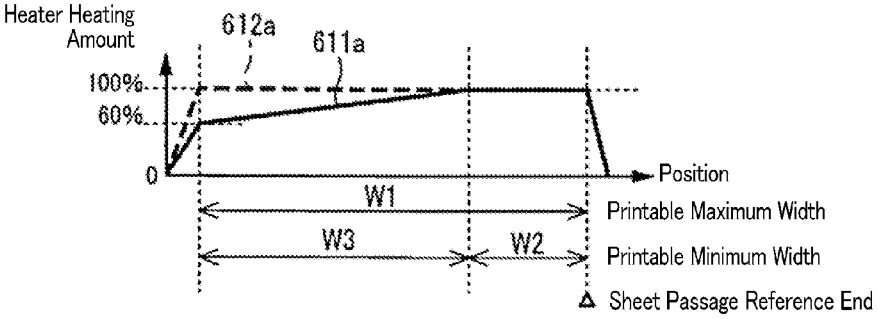

FIG. 4A and 4B are explanatory views that show a distribution of a heating amount of the fuser according to the first embodiment. FIG. 4A shows a sheet passage position of a sheet in the fuser 6 and positions of the fuser thermistor 62 and the pressure application thermistor 72, as seen from an upstream side in the sheet carrying direction. FIG. 4B shows distributions of heating amounts of the main heater 611 and the sub heater 612 in the fuser 6 in a direction perpendicular to the sheet carrying direction (hereinafter, may be referred to as "sheet width direction.")

As illustrated in FIG. 4A, in the image forming apparatus of the present embodiment, a passage reference position is set a sheet passage reference end on a right end when the fuser 6 is seen from the upstream side in the sheet carrying direction. When print is performed on a sheet with either a printable maximum width W1 or a printable minimum width W2, sheet passage is performed using the sheet passage reference end as a reference. Therefore, positions of the fuser thermistor 62 and the pressure application thermistor 72 are always arranged in a sheet passage region with respect to all sheets with printable sheet width.

As illustrated in FIG. 4B, the sub heater 612 (FIG. 3) as the auxiliary heating unit is set such that a heating amount distribution 612a illustrated by a broken line in the figure is an incessantly constant heating amount with respect to the printable maximum width W1 (the heating amount distributed in a direction perpendicular to the medium carrying direction is at least partially different from a heating amount distribution of the main heater 611). The main heater 611 (FIG. 3) as the main heating unit is set such that a heating amount distribution 611 a illustrated by a solid line in the figure is incessantly constant with respect to the printable minimum width W2. Also, in the heating amount with respect to a width W3 that is wider than the printable minimum width W2, the heating amount is set to suppress the heating amount to be smaller than the heating amount of the printable minimum width W2. In other words, the main heater 611 (FIG. 3) is set such that a heating amount of one end part in the direction perpendicular to the medium carrying direction is smaller than a heating amount of the other end.

When print is performed on a sheet with a wide width, the sheet absorbs heat of an entire surface in the sheet width direction. On the other hand, when print is performed on a sheet with a narrow width, the sheet doesn't absorb heat of a region where sheet doesn't pass, so that heat accumulates and a temperature of the region (for example the fuser belt 63 in FIG. 3) becomes high. When it is remarkable, the temperature exceeds a heat resisting temperature and it may destroy the members.

However, as the present embodiment, when the sub heater 612 (FIG. 3) is set to have the incessantly constant heating amount with respect to the printable maximum width W1, and the main heater 611 (FIG. 3) is set to have the incessantly constant heating amount with respect to the printable minimum width W2 and to have the heating amount smaller than that of the W2 with respect to a width W3 that is wider than the printable minimum width W2, necessary heating amount can be kept for both wide width sheet and narrow width sheet, and excessive heating of a region where sheet doesn't pass can be prevented. Note, the pressure application heater 71 illustrated in FIG. 3 has the same heating amount distribution as the sub heater 612.

Figure 5A:
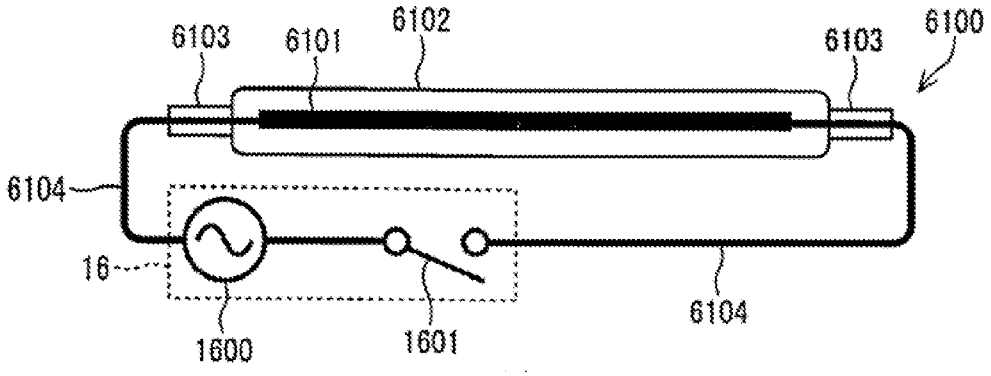
FIG. 5A and 5B are explanatory views of a configuration of the heaters according to the first embodiment.
Figure 5B:
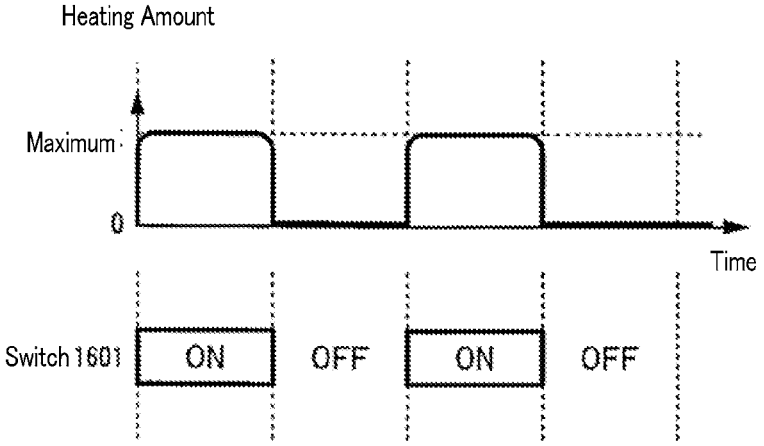
Figure 6:
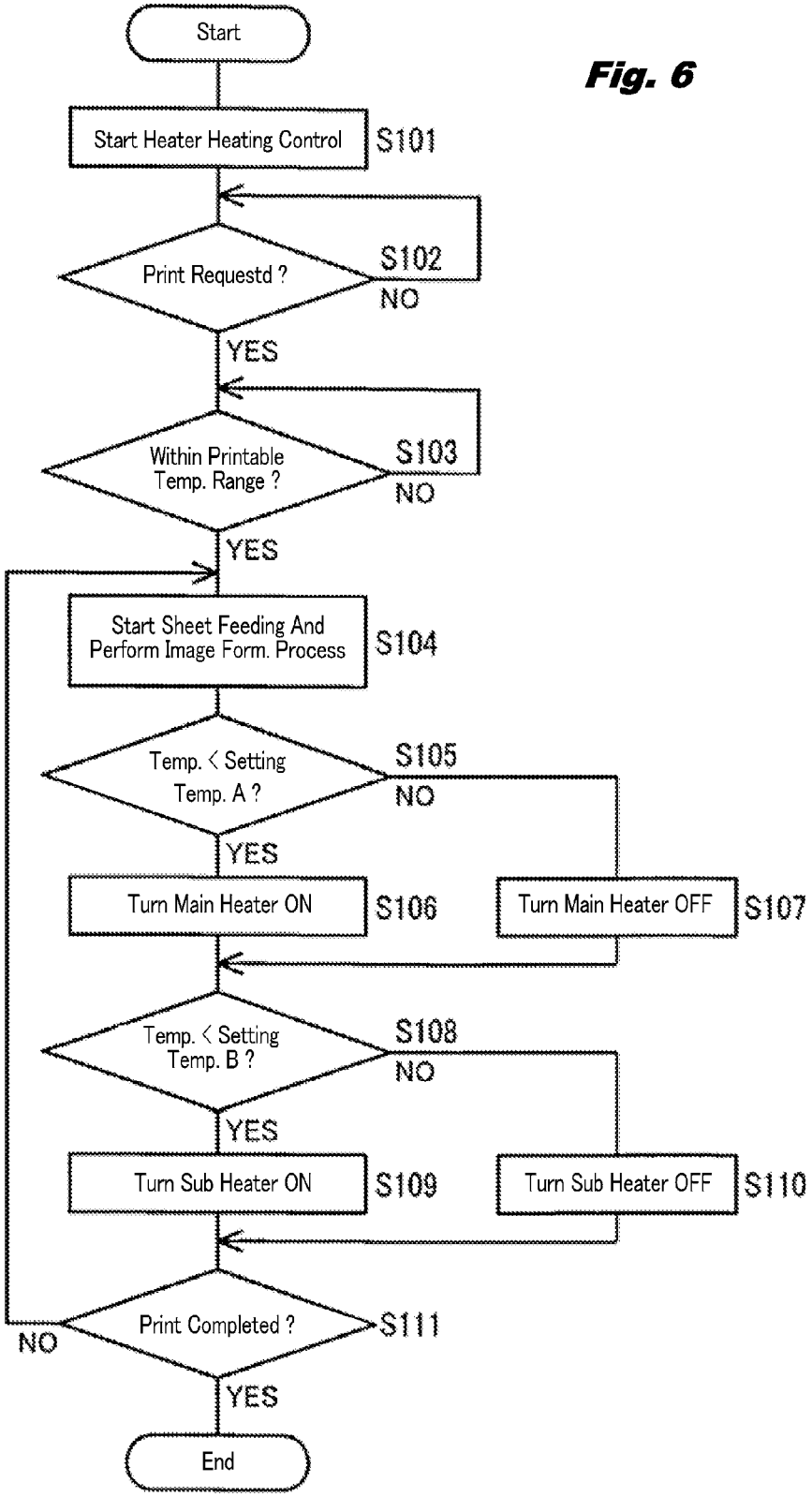
FIG. 6 is a flow diagram that shows a flow of a print process according to the first embodiment.

FIG. 5A and 5B are explanatory views of a configuration of the heaters according to the first embodiment. FIG. 5A shows a configuration of the main heater 611, the sub heater 612, and the pressure application heater 71 illustrated in FIG. 3. FIG. 5B shows a relationship between control signal and heating amount. Note, the configuration illustrated in FIG. 5A is common for the heaters. In FIG. 5A, the heater 6100 includes a filament 6101 as a heating body, filler gas, a glass tube 6102 as a holding member that holds the filament 6101, and a supporting member (not shown) that supports the heater 6100 in the inside of the fuser belt 63 and the pressure application belt 73 illustrated in FIG. 3, and insulators 6103 that electrically insulates the supporting member, and a heater wiring 6104 that transmits power supplied from the power supply 16 to the filament 6101.

Also, the heater power supply 16 includes a AC power supply 1600 and a switch 1601 that controls power supply to the heater 6100. The filament 6101 is filled in the glass tube 6102, insulators 6103 are arranged on both end parts of the glass tube 6102, and the filament 6101 and the heater wiring

6104 are connected in the insulator 6103. For the filament 6101, for example, tungsten filament and the like is used.

In the main heater 611, the sub heater 612, and the pressure application heater 71, one end of the heater wiring 6104 is connected to the AC power supply 1600 of the heater power supply 16, and the other end is connected to the switch 1601. The switch 1601 includes control signal that controls a passage condition of output, and the control signal is connected to the heating controller 103 of the print controller 100 illustrated in FIG. 3. One end of the switch 1601 is connected to the AC power supply 1600, and the other end is connected to the heater wiring 6104.

Therefore, by switching connection (ON) and non-connection (OFF) of the switch 1601 depending on heater driving signals from the heating controller 103 of the print controller 100, it is possible to shut the supply of power from the AC power supply 1600 to the heater 6100, and also it is possible to control power supply to the heater 6100 based on an instruction from the heating controller 103 of the print controller 100. Note, each of the heaters (the main heater 611, the sub heater 612, and the pressure application heater 71) has its own switch 1601, and the heating controller 103 of the print controller 100 is able to perform temperature control of each of the heaters by controlling power supplied to each of the heaters.

The glass tube 6102 is filled with bromine, chlorine, and the like in halogenated organic state as well as inert gases such as argon and krypton. By causing halogen cycle between halogen and tungsten generated when heating and cooling are performed, heating function can be provided throughout the product life cycle. For the insulator 6103, an insulator made of ceramics for example is used, and for the switch 1601, a semiconductor switch made of such as triac in which a large amount of current may flow is used.

Power supplied from the heater power supply 16 is supplied to the filament 6101 through the heater wiring 6104, and the filament 6101 is heated using the power. The glass tube 6102 is translucent and penetrates heat generated by the heating of the filament 6101, and then the heat is transferred to the inside of the fuser belt 63 and the pressure application belt 73 illustrated in FIG. 3. Because only two conditions that are a supplying status and a shutting status of the AC power supply 1600 can be created with the switch 1601 of the heater power supply 16, adjustment of the heating amount of the heater 6100 is performed by adjusting duration of time of power supply (ON) and duration of time of power shut (OFF) in a predetermined duration of time as illustrated in FIG. 5B.

Figure 11A:
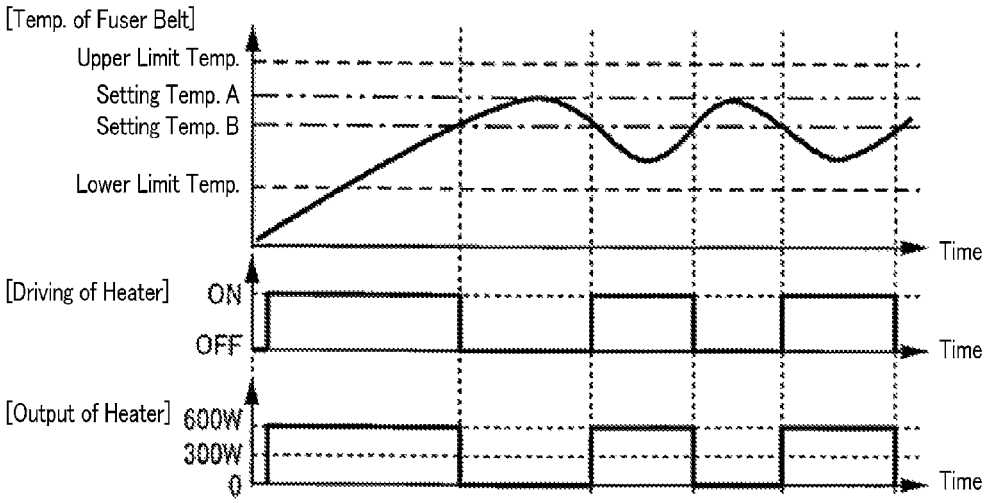
FIGS. 11A-11B are explanatory views of temperature control of a comparative example.
Figure 11B:
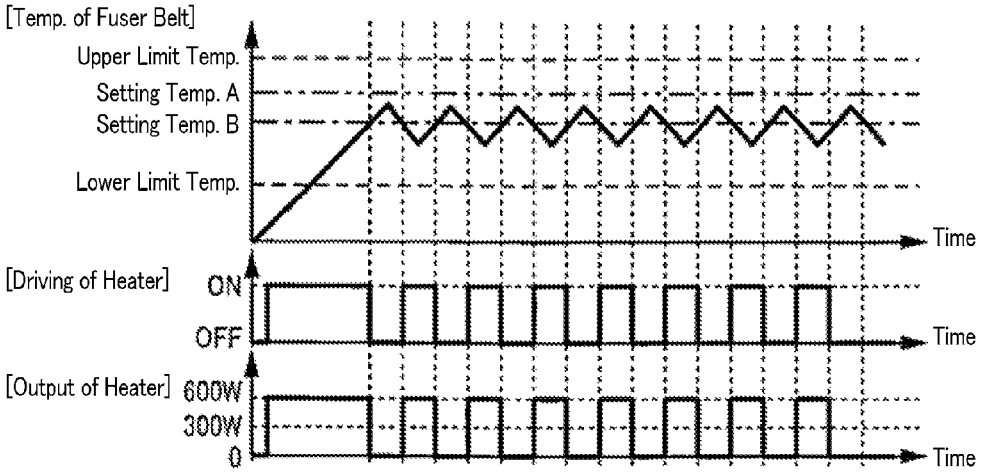

Here, a comparative example is explained. FIGS. 11A-11B are explanatory views of temperature control of a comparative example. FIG. 11A is a graph of temperature control of the comparative example in which a fuser with a large heat capacity is used. FIG. 11B is a graph that shows a case that the same temperature control as the comparative example was performed with the fuser with a small heat capacity of the present embodiment. As illustrated in FIG. 11A, when a heat capacity of the fuser member is large, temperature change is suppressed sufficiently small even when a period of ON of heater driving is long. This is because heat given to the fuser member is slowly come out to the surface.

On the other hand, as illustrated in FIG. 11B, when it is attempted to keep a temperature change of the fuser member in a predetermined temperature range with the fuser member with the small heat capacity, it needs to switch ON and OFF of the heater driving in a shorter period than a case when the fuser member with the large heating amount is used. The period is sometimes performed in several ms unit for example. This is because heat given to the fuser member is come out fast to the surface, and it is remarkable when a configuration that heat from the heater is given directly to the fuser member as the one in the present embodiment is used.

In such heating control that repeats the switch of ON and OFF of the heating driving in a shorter period, it is known that noise occurs in the heater power supply. In order to obtain a standard that is capable of the noise, various measurements are required. As a result, there is a problem that a cost of the heater supply is increases. Also, when output of the heater itself is suppressed, it is possible to suppress the occurrence of noise because flowing current is suppressed. However, when it is requested to print in a high speed, heating amount lacks and a temperature of the fuser member cannot be maintained.

As described above, in the temperature control of the fuser member in the comparative example, it is difficult to perform an appropriate temperature control of the heater using an inexpensive power supply when the fuser member with a small heating amount and an inexpensive heater are used. In the present embodiment, in order to solve such problems, a plurality of heaters with a small heating amount is provided. One of the heaters always heats during printing, and the other heater is used to adjust the temperature of the fuser member. Therefore, sufficient heating amount is ensured.

Actions of the above-described configuration are explained. The print process performed by the image forming apparatus is explained as following steps (S) illustrated in the flow diagram that shows the flow of the print process of the first embodiment as referring to FIGS. 1 2 and 3. S101: Upon turning on the power supply of the image forming apparatus 1, in order to heat the fuser motor 20 entirely with the motor controller 101, the fuser motor 20 is driven by the motor controller 101 to rotate the fuser roller 65 and then a state that the fuser belt 63 is rotated is obtained. Also, a control of heating the heaters is started by the heating controller 103.

At this time, in the print controller 100, the main heater 611, the sub heater 612, and the pressure application heater 71 are selected as heaters to be used by the heater selection part 102. The main heater 611 and the sub heater 612 are temperature controlled such that a temperature of the fuser belt 63 detected by the fuser thermistor 62 becomes a printable temperature. The pressure application heater 71 is temperature controlled such that a temperature of the pressure application belt 73 detected by the pressure application thermistor 72 becomes a printable temperature. Note, a printable temperature of the fuser belt 63 is for example 160° C. and a printable temperature of the pressure application belt 73 is for example 130° C.

S102: The print controller 100 judges the occurrence of a print request from an external part such as a host device. When an occurrence of the print request is detected, the process proceeds to S103. When no occurrence of the print request is detected, the heating control is stopped, the fuser motor 20 is stopped as well, and it awaits an occurrence of the print request. S103: When the occurrence of the print request is detected, in the print controller 100, in order to heat the fuser 6 entirely to the printable temperature, the fuser motor 20 is driven by the motor controller 101 to rotate the fuser roller 65 and then the state that the fuser belt 63 is rotated is obtained. Also, a control of heating the heaters is started by the heating controller 103.

At this time, in the print controller 100, the main heater 611, the sub heater 612, and the pressure application heater 71 are selected as heaters to be used by the heater selection part 102. The main heater 611 and the sub heater 612 are temperature controlled by the heating controller 103 such that a temperature of the fuser belt 63 detected by the fuser thermistor 62 becomes a printable temperature. The pressure application heater 71 is temperature controlled such that a temperature of the pressure application belt 73 detected by the pressure application thermistor 72 becomes a printable temperature. Note, a printable temperature of the fuser belt 63 is for example 160° C. and a printable temperature of the pressure application belt 73 is for example 130° C.

The print controller 100 that have started the heater heating control judges whether a temperature of the fuser belt 63 detected by the fuser thermistor 62 is in a printable range. When the temperature is judged to be in the printable range, the process proceeds to S104 to start print.

When the temperature of the fuser belt 63 is judged to be out of the printable range, the heater heating control is continued until the temperature becomes in the printable range.

Herein, the printable temperature range of the fuser belt 63 is a range that a subsequent print is preferably performed when print starts in the range, which is for example a range of 150-170° C. When the temperature of the fuser belt 63 is lower than the printable temperature range, the heating controller 103 heats the main heater 611 and the sub heater 612 with the heater power supply 16. Meanwhile, when the temperature of the fuser belt 63 is higher than the printable temperature range, the heating controller 103 turns off the switch of the heater power supply 16 and waits until the temperature is decreased. Also, the print controller 100 performs the heater heating control of the pressure application belt 73 as well until the temperature of the pressure application belt 73 becomes in the printable temperature range.

S104: In the print controller 100, the sheet carrying motor 18 is driven by the motor controller 101 to feed and carry a sheet, and then toner image is formed on the sheet when an image forming process is performed by the toner image forming part 5. S105: The print controller 100 detects a temperature of the fuser thermistor 62 and compares the detected temperature with a setting temperature A. When the detected temperature is judged to be lower than the setting temperature A, the process proceeds to S106. When the detected temperature is judged to be equal to or higher than the setting temperature A, the process proceeds to S107. Herein, the setting temperature A is defined as following: at the temperature or a temperature higher than the temperature, print error due to excessive heating doesn't occur when the main heater 611 is turned off; and the temperature is higher than the printable temperature and lower than a temperature at which fusing error doesn't occur and members are not damaged.

S106: When the temperature detected by the fuser thermistor 62 is judged to be lower than the setting temperature A, the heater selection part 102 and the heating controller 103 of the print controller 100 turn the main heater 611 on, and the process proceeds to S108. S107: When the temperature detected by the fuser thermistor 62 is judged to be equal to or higher than the setting temperature A, the heater selection part 102 and the heating controller 103 of the print controller 100 turn the main heater 611 off, and the process proceeds to S108

S108: Next, the print controller 100 detects the temperature of the fuser thermistor 62, and compares the detected temperature with a setting temperature B. When the detected temperature is judged to be lower than the setting temperature B, the process proceeds to S109. When the detected temperature is judged to be equal to or higher than the setting temperature B, the process proceeds to S110. Herein, the setting temperature B is defined as following: at the temperature or a temperature higher than the temperature, fusing error due to deficiency of heating amount doesn't occur when the sub heater 612 is turned on; and the temperature is the same temperature as the printable temperature in the present embodiment.

S109: When the temperature detected by the fuser thermistor 62 is judged to be lower than the setting temperature B, the heater selection part 102 and the heating controller 103 of the print controller 100 turn the sub heater 612 on, and the process proceeds to S111. S110: When the temperature detected by the fuser thermistor 62 is judged to be equal to or higher than the setting temperature B, the heater selection part 102 and the heating controller 103 of the print controller 100 turn the sub heater 612 off, and the process proceeds to S111.

S111: The print controller 100 judges whether print process regarding the print request is completed, and the present process is finished when it is judged as that the print process is completed. When it is judged as that there is still remaining process to be printed, the process proceeds back to S104, and the print process is continued. As described above, when ON/OFF control of the main heater 611 and the sub heater 612 are repeatedly performed, even with the fusing system that the fusing belt with a small heat capacity is directly heated by the heaters, it is possible to sufficiently suppress the temperature change of the fusing belt, suppress the change amount of current and the frequency of current change low, and suppress the increase of the cost of the heater power supply.

Figure 7A:
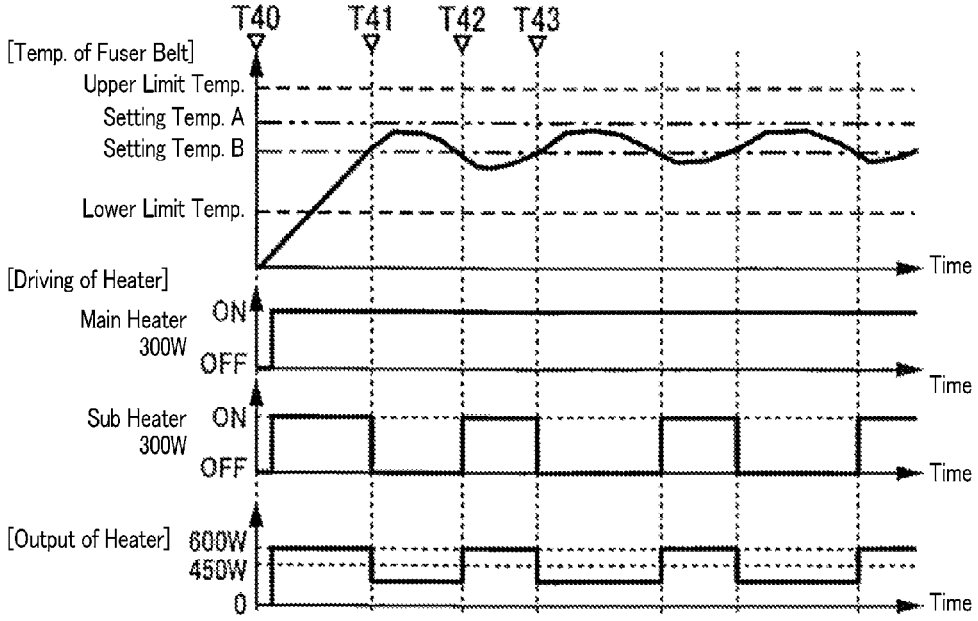
FIG. 7A and FIG. 7B are explanatory views of temperature control of the first embodiment.
Figure 7B:
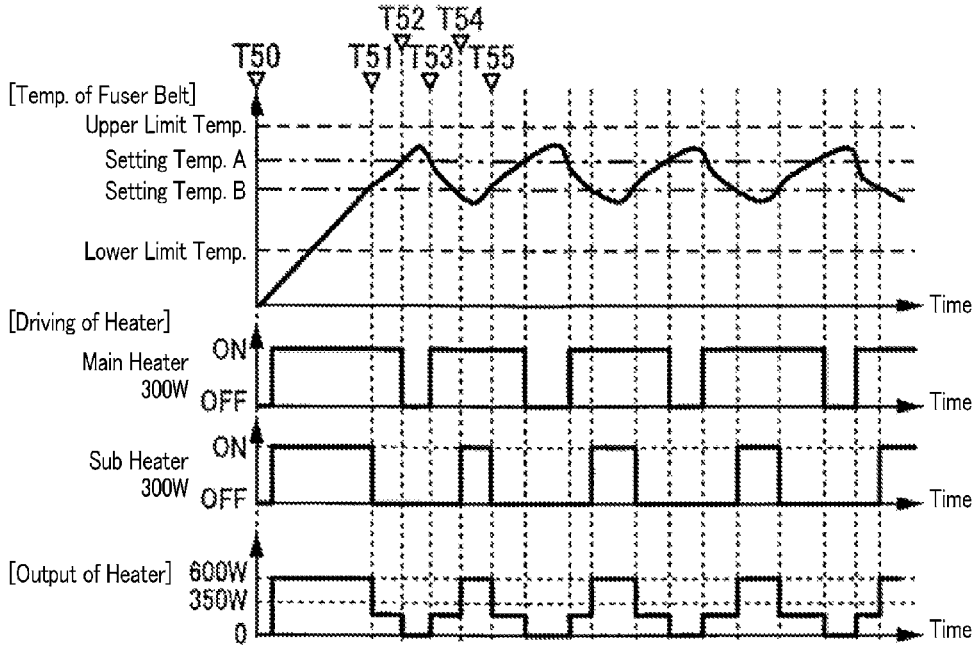

FIG. 7A and 7B are explanatory views of temperature control of the first embodiment, and is a graph that shows a relationship between the temperature change of the fuser belt 63 illustrated in FIG. 3 with time and the heater driving signal. FIG. 7A is an explanatory view of temperature control when high speed print is performed. FIG. 7B is an explanatory view of temperature control when low speed print is performed. As illustrated in FIG. 7A, in the case of high speed print, the amount of sheets passing through the fuser for certain duration of time is large, and therefore the heating amount transferred from the fuser belt 63 illustrated in FIG. 3 to the sheets becomes large. As a result, an entire heating amount that should be supplied to the fuser belt 63 becomes large, and in the present embodiment, 450 W in average for example is required.

The temperature control of the fuser belt in the case of high speed print is explained following timings indicated by T in FIG. 7A and referring to FIG. 3. T40: Upon the receipt of the print request by the print controller 100, the print controller 100 starts heater driving control of the main heater 611 and the sub heater 612 with the heater selection part 102 and the heating controller 103. T41: The print controller 100 that started the heater driving control starts sheet carrying and print action when the temperature of the fuser belt 63 becomes in the printable temperature range. The print controller 100 continues the heater driving control with the heating controller 103, and when the temperature of the fuser belt 63 becomes the setting temperature B or more, the sub heater 612 is turned off by the heater selection part 102 and the heating controller 103.

As a result, the temperature of the fuser belt 63 is decreased, but the temperature change is gradual because the main heater 611 is kept on. Herein, the output of the sub heater 612 is suppressed low to be 300 W, so current change at the time of state change from on state to off state can be suppressed low, and noise generated by the heater power supply 16 can be suppressed low. Note, in the case of high speed print, because the amount of heat transferred to the sheets is large between T41 and T42, it is impossible to maintain the temperature of the fuser belt 63 only with 300 W of the main heater 611, and the temperature of the fuser belt 63 is decreased. Therefore, the temperature of the fuser belt 63 doesn't exceed the setting temperature, and the main heater 611 is always on.

T42: When the print is continued and the temperature of the fuser belt 63 continuously is decreased and becomes lower than the setting temperature B, the print controller 100 turns the sub heater 612 on with the heater selection part 102 and the heating controller 103. As a result, the heating amount supplied to the fuser belt 63 is increased, and then the temperature of the fuser belt 63 is increased. T43: When the temperature of the fuser belt 63 becomes the setting temperature B or more, the print controller 100 turns the sub heater 612 off with the heater selection part 102 and the heating controller 103.

As described above, in the case of high speed print, the main heater 611 is selected and is always kept on by the heater selection part 102 and the heating controller 103 and the control of on/off of the sub heater 612 is performed. As a result, the temperature of the fuser belt 63 can be maintained in the range, and also the current change of the heater power supply 16 can be suppressed small. On the other hand, as illustrated in FIG. 7B, in the case of low speed print, the amount of sheets passing through the fuser for certain duration of time is small, and therefore the heating amount transferred from the fuser belt 63 illustrated in FIG. 3 to the sheets becomes small. As a result, an entire heating amount that should be supplied to the fuser belt 63 becomes small, and in the present embodiment, 350 W in average for example is required.

The temperature control of the fuser belt in the case of low speed print is explained following timings indicated by T in FIG. 7B and referring to FIG. 3. T50: Upon the receipt of the print request by the print controller 100, the print controller 100 starts heater driving control of the main heater 611 and the sub heater 612 with the heater selection part 102 and the heating controller 103. T51: The print controller 100 that started the heater driving control starts sheet carrying and print action when the temperature of the fuser belt 63 becomes in the printable temperature range. The print controller 100 continues the heater driving control with the heating controller 103, and when the temperature of the fuser belt 63 becomes the setting temperature B or more, the sub heater 612 is turned off by the heater selection part 102 and the heating controller 103.

As a result, the temperature of the fuser belt 63 is decreased, but the temperature change is gradual because the main heater 611 is kept on. Note, in the case of low speed print, heating amount transferred from the fuser belt 63 is small, and therefore the temperature of the fuser belt 63 is increased and becomes the setting temperature A or more. T52: When the temperature becomes the setting temperature A or higher, the print controller 100 turns the main heater 611 off with the heater selection part 102 and the heating controller 103.

Herein, the respective outputs of the main heater 611 and the sub heater 612 are suppressed low to be 300 W, so current change at the time of state change from on state to off state can be suppressed low, and noise generated by the heater power supply 16 can be suppressed low. Also, it is possible to suppress generation of unnecessary noise because state changes between on state and off state of the main heater 611 and the sub heater 612 don't occur simultaneously. As described above, in T52-T53, both the main heater 611 and the sub heater 612 are off, so no heat is supplied to the fuser belt 63 and the temperature of the fuser belt 63 is decreased. Also, because low speed print is performed, the temperature decrease is gradual.

T53: When the print is continued and the temperature of the fuser belt 63 is continuously decreased and becomes lower than the setting temperature A, the print controller 100 turns the main heater 611 on with the heater selection part 102 and the heating controller 103. As a result, the temperature change of the fuser belt 63 becomes further gradual. However, the supplied heating amount is not sufficient, so that the temperature of the fuser belt 63 is continuously decreased. T54: When the print is continued and the temperature of the fuser belt 63 is continuously decreased and becomes lower than the setting temperature B, the print controller 100 turns the sub heater 612 on with the heater selection part 102 and the heating controller 103. As a result, the heating amount supplied to the fuser belt 63 is increased, and then the temperature of the fuser belt 63 is increased.

T55: When the temperature of the fuser belt 63 becomes the setting temperature B or more, the print controller 100 turns the sub heater 612 off with the heater selection part 102 and the heating controller 103. As described above, in the case of low speed print, it is possible to maintain the temperature of the fuser belt 63 in the predetermined range and keep the current change of the heater power supply 16 low by controlling on/off of the main heater 611 and the sub heater 612.

As described above, in the first embodiment, in order to control the temperature of the fuser member, a plurality of heaters whose output heating amounts are suppressed low are provided, only one heater always outputs heat, and output heating amount is controlled with the other heater. As a result, it is possible to obtain effects that sufficient heating amount for the fuser member is secured, the temperature change of the fuser member is controlled, and the occurrence of fusing error of toner is suppressed. Also, by suppressing change of current value of current supplied to the heaters, it is possible to obtain effects that noise generated by the heater power supply is suppressed low and the increase in the cost of the heater supply is suppressed.

<Second Embodiment>

A configuration of a second embodiment is the one that a sheet width wetting part is added to the configuration of the first embodiment. The configuration of the second embodiment is explained based on FIG. 8 that is a block diagram that shows a control configuration of an image forming apparatus according to the second embodiment. Note, to elements that are the same as the ones in the first embodiment, the same reference numbers are given and explanation thereof is omitted.

Figure 8:
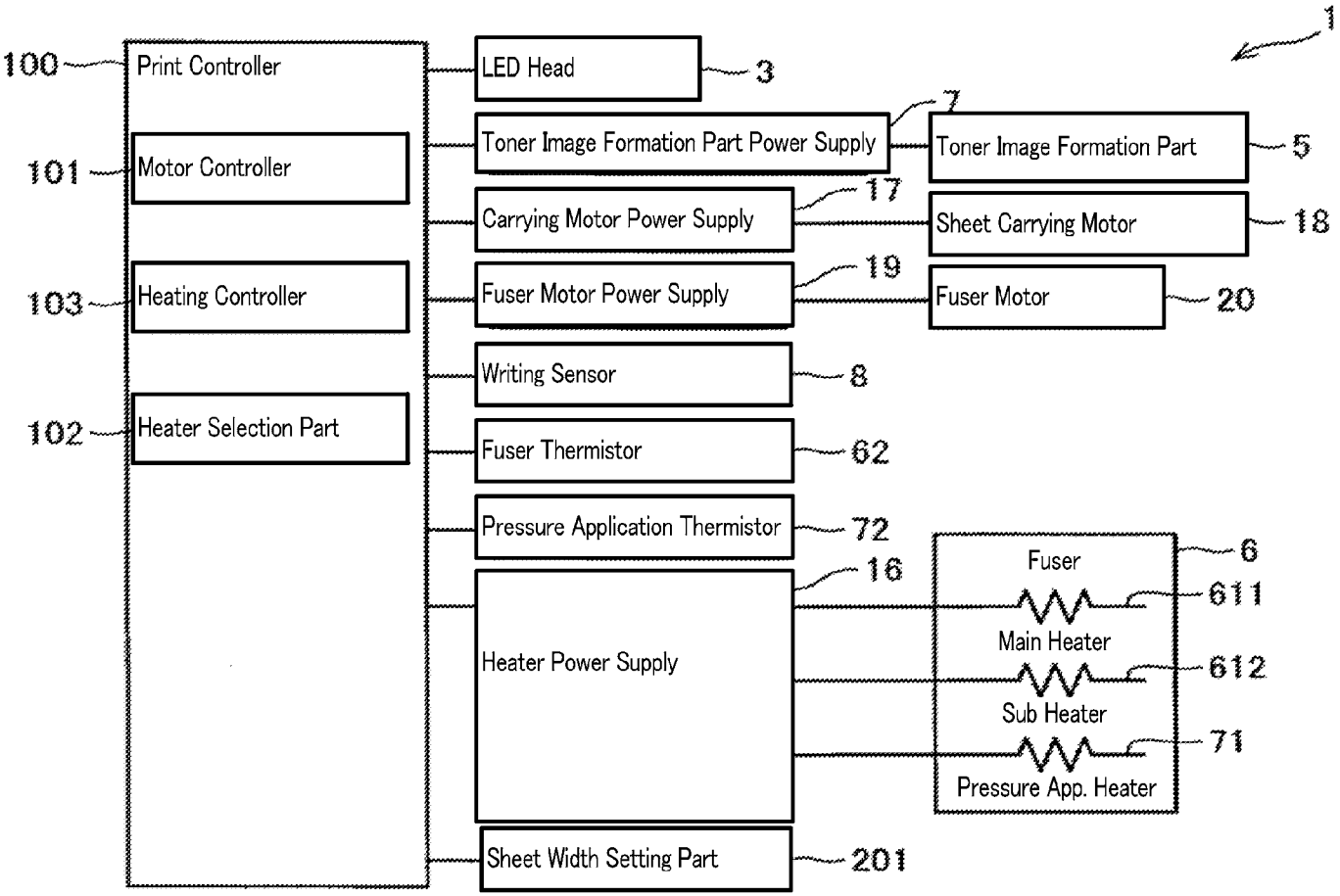
FIG. 8 is a block diagram that shows a controller configuration according to a second embodiment.
Figure 9:
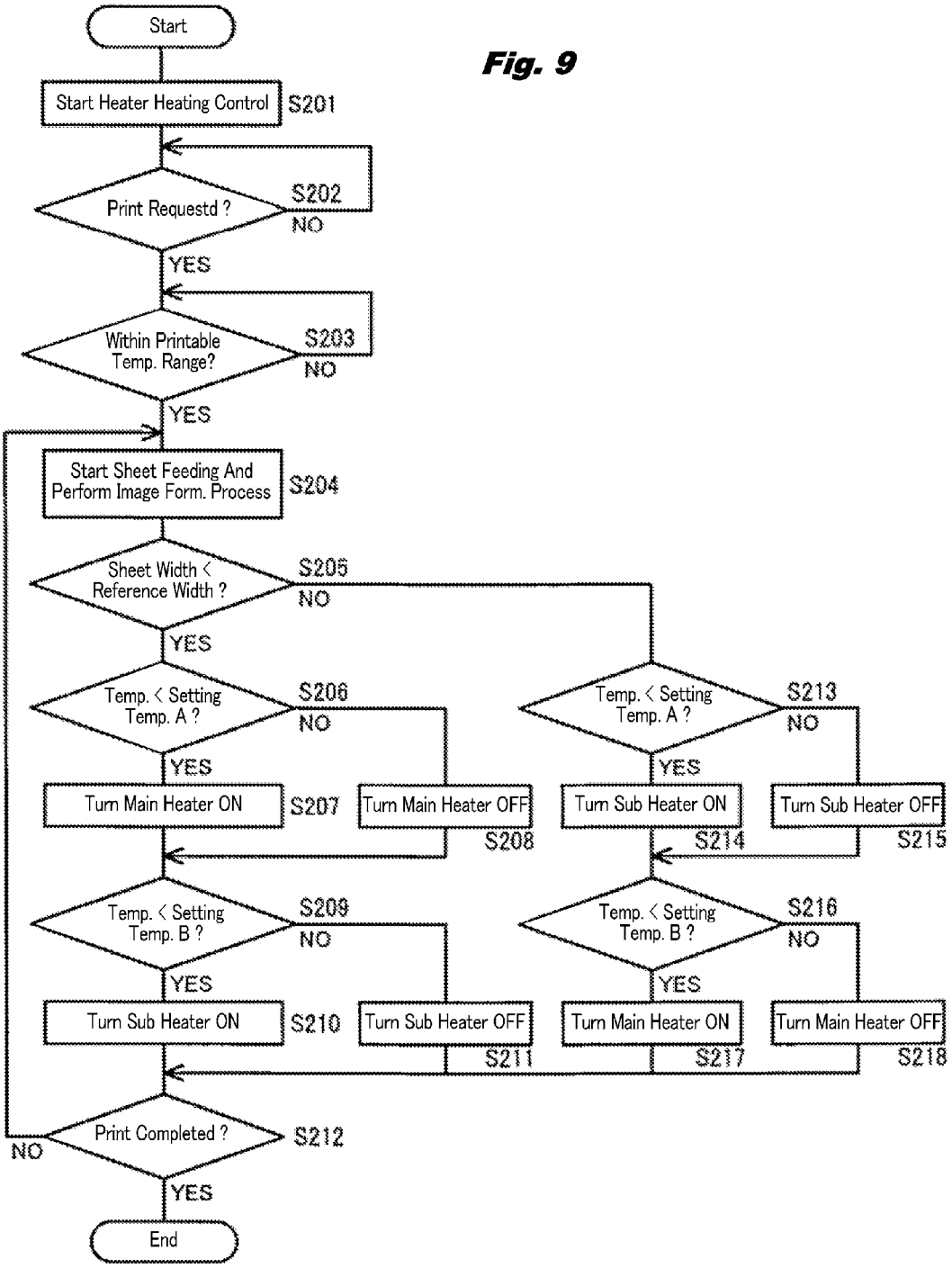
FIG. 9 is a flow diagram that shows a flow of a print process according to the first embodiment.

In FIG. 8, the image forming apparatus 1 includes a print controller 100, the LED head 3, the toner image forming part 5, a toner image forming part power supply 7, a carrying motor power supply 17, a sheet carrying motor 18, a fuser motor power supply 19, a fuser motor 20, the writing sensor 8, a fuser thermistor 62, a pressure application thermistor 72, a heater power supply 16, and the fuser 6 that includes a main heater 611, a sub heater 612, and a pressure application heater 71. A sheet width setting part 201 is connected to the print controller 100.

The sheet width setting part 201 as a width setting unit receives a user input operation that sets sheet width at an operation part, and stores an input sheet width in a memory part memorize. In the present embodiment, the heating controller 103 of the print controller 100 performs temperature control of the main heater 611 or the sub heater 612 selected by the heater selection part 102 depending on sheet width set by the sheet width setting part 201

Effects of the above-described configuration are explained. The print process performed by the image forming apparatus is explained as following steps (S) illustrated in the flow diagram that shows the flow of the print process of the second embodiment as referring to FIGS. 2, 3 and 8. First, in the present embodiment, the sheet width setting part 201 of the image forming apparatus 1 receives an input operation that inputs information that indicates a sheet width of a sheet to be printed, and lets the memory part memorize as information of the sheet width.

S201~S204: Because the steps have the processes the same as S101~S104, explanation thereof is omitted. S205: The print controller 100 receives width information of the sheet currently under printing from the sheet width setting part 201, compares the received width information of the sheet with reference width information, and judges if the width of the sheet of the received width information is narrower than the reference width. When it is judged that the width of the sheet is narrower, the process proceeds to S206, and the same process as the first embodiment is performed. When it is judged that the width of the sheet is equal to or wider than (is not narrower than) the reference width, the process proceeds to S213.

Herein, the reference width means a sheet width that a larger amount of heating amount is needed in the other end part opposite to the sheet passage reference end, and is for example 200 mm. Next, a method for setting width information of a printed sheet with the sheet width setting part 201 is explained. A user sets a width of a print sheet contained in the image forming apparatus 1 by operating and inputting with the sheet width setting part 201.

Specifically, the image forming apparatus 1 includes an operation panel as an inputting unit for a user to set various types of information such as thickness of print sheet. As one part of the unit, the sheet width setting part 201 is provided. For example, Letter size (215.9 mm), A4 size (210 mm), and the like are preset such that a user can select from those. The sheet width setting part 201 stores a width of print sheet selected by a user as width information of a sheet to be printed in the memory part.

Note, in the present embodiment, the sheet width setting part 201 is provided to receive a setting operation by the user; however, it is also possible to attach a sheet size detection mechanism, a sensor, and the like to the sheet cassette containing a print sheet so as to automatically detect a width of a print sheet. Also, it is possible to set a width and sheet size of a print sheet by using a printer driver software in a host device such as a personal computer.

S206~S212: Because the steps have the processes the same as S105~S111, explanation thereof is omitted. S213: When it is judged that the width of the sheet to be printed is equal to or wider than the reference width, the print controller 100 detects a temperature of the fuser thermistor 62, and compares the detected temperature with the setting temperature A. When it is judged that the detected temperature is lower than the setting temperature A, the process proceeds to S214. When it is judged that the detected temperature is equal to or higher than the setting temperature A, the process proceeds to S215.

S214: When it is judged that the temperature detected by the fuser thermistor 62 is lower than the setting temperature A, the heater selection part 102 and the heating controller 103 of the print controller 100 turns the sub heater 612 on, and the process proceeds to S216. S215: When it is judged that the temperature detected by the fuser thermistor 62 is equal to or higher than the setting temperature A, the heater selection part 102 and the heating controller 103 of the print controller 100 turns the sub heater 612 off, and the process proceeds to S216. S216: Next, the print controller 100 detects the temperature of the fuser thermistor 62, and compares the detected temperature with the setting temperature B. When it is judged that the detected temperature is lower than the setting temperature B, the process proceeds to S217. When it is judged that the detected temperature is equal to or higher than the setting temperature B, the process proceeds to S217.

S217: When it is judged that the temperature detected by the fuser thermistor 62 is lower than the setting temperature B, the heater selection part 102 and the heating controller 103 of the print controller 100 turns the main heater 611 on, and the process proceeds to S212. S218: When it is judged that the temperature detected by the fuser thermistor 62 is equal to or higher than the setting temperature B, the heater selection part 102 and the heating controller 103 of the print controller 100 turns the main heater 611 off, and the process proceeds to S212.

As described above, when a width of a sheet to be printed is equal to or wider than the reference width, it is possible to supply a larger heating amount to a sheet end part that is the other end opposite to the sheet passage reference end by keeping the sub heater 612 always on, the sub heater 612 having a larger heating amount in the sheet end part that is the other end opposite to the sheet passage reference end and adjusting the temperature of the fuser belt 63 with the main heater 611. As a result, it is possible to suppress occurrence of fusing error due to deficiency of heating amount in the sheet end part that is the other end opposite to the sheet passage reference end. Furthermore, when a width of a sheet to be printed is smaller than the reference width, it is possible to suppress a heating amount given to a non sheet passage part small and prevent excessive heating of the non sheet passage part by keeping the main heater 611 always on, the main heater 611 having a smaller heating amount in the sheet end part that is the other end opposite to the sheet passage reference end and adjusting the temperature of the fuser belt 63 with the sub heater 612 having a larger heating amount in the sheet end part.

Figure 10A:
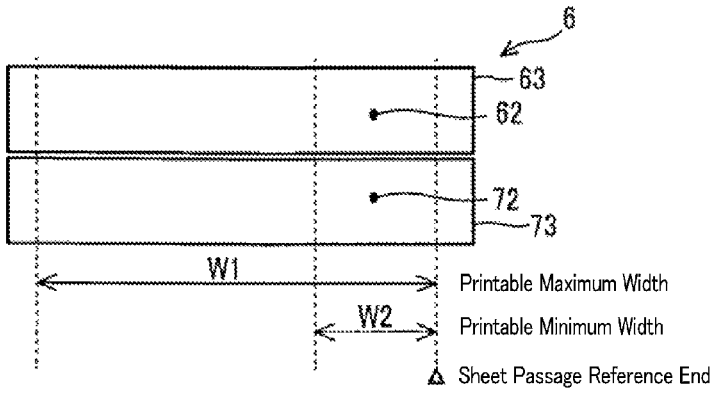
FIGS. 10A-10D are explanatory views that show distributions of heating amount of the fuser device in the second embodiment.
Figure 10B:
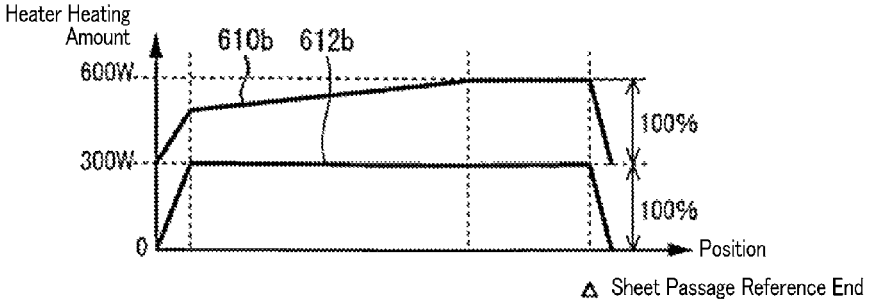
Figure 10C:
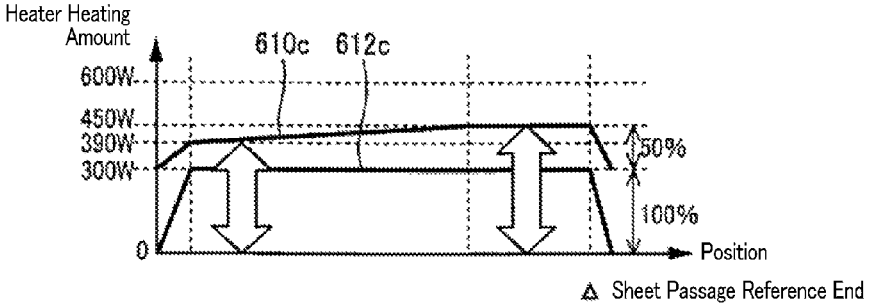
Figure 10D:
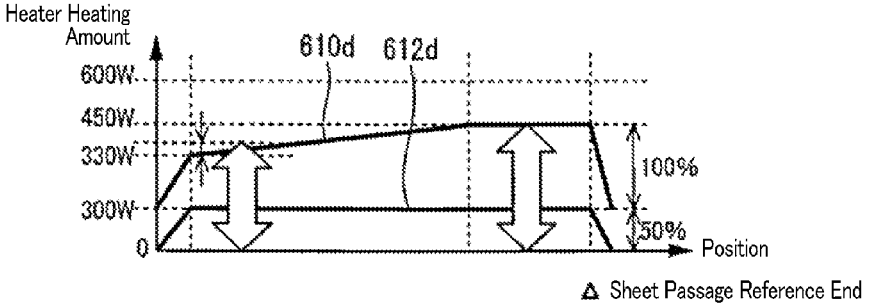

FIGS. 10A-10D are explanatory views that show distributions of heating amount of the fuser device in the second embodiment. FIG. 10A shows a sheet passage position of a sheet in the fuser 6 and positions of the fuser thermistor 62 and the pressure application thermistor 72, as seen from an upstream side in the sheet carrying direction. FIG. 10B-10D show distributions of heating amounts of the main heater 611 and the sub heater 612 (FIG. 3) in the fuser 6 in the sheet width direction.

FIG. 10B shows a total heating amount 610b when both the main heater 611 and the sub heater 612 (heating amount 612*b*) are driven at the same time. FIG. 10C shows a total heating amount 610*c* when the sub heater 612 is always on (heating amount 612*c*) and the main heater 611 is driven on with a 50% duty cycle. FIG. 10D shows a total heating amount 610*d* when the main heater 611 is always on and the sub heater 612 is driven on with a 50% duty cycle (heating amount 612*d*). In other words, FIG. 10C shows a case that a width of a print to be printed is equal to or wider than the reference width, and FIG. 10D shows a case that a width of a print to be printed is narrower than the reference width.

As illustrated in FIG. 10C and FIG. 10D, a heating amount in the sheet end part that is the other end opposite to the sheet passage reference end is larger when a width of a sheet to be printed is equal to or wider than the reference width (FIG. 10C) as compared to when a width of a sheet to be printed is narrower than the reference width (FIG. 10D). As a result, when a width of a sheet to be printed is equal to or wider than the reference width, a heating amount in the sheet end part that is the other end opposite to the sheet passage reference end is larger, and sufficient heating amount can be given to the sheet. On the other hand, when a width of a sheet to be printed is narrower than the reference width, a heating amount in the sheet end part that is the other end opposite to the sheet passage reference end can be suppressed small, and excessive heating in the non sheet passage part can be prevented.

Furthermore, when a width of a print to be printed is narrower than the reference width, a heating amount accumulated in the non sheet passage part, and therefore the non sheet passage part is more likely to be excessively heated. However, even at the same speed and temperature, the area of a sheet passing through the fuser is small. As a result, the heating amount transferred to the sheet is small, and a heating amount required to maintain the passage region at the same temperature is small. Therefore, as the sheet width becomes narrower, the percentage of the duty cycle for keeping heaters on becomes smaller. According to the result shown in FIG. 10D, the percentage of the duty cycle for keeping the sub heater on becomes small. Therefore, the heating amount given to the non sheet passage part becomes smaller, and an advantage of preventing excessive heating of the non sheet passage part is enhanced.

As described above, in the second embodiment, it is enabled to select the heaters depending on a width of a sheet to be printed in addition to the effect of the first embodiment. As a result, deficiency of heating amount in the end part of sheet is suppressed when a sheet with a wider width is printed, and also excessive heating of the non sheet passage part can be prevented when a sheet with a narrower width is printed. Note, in the first embodiment and the second embodiment, explanation was given using a printer as the image forming apparatus, but not limited to this. A facsimile device, a photocopier device, and a multifunctional peripheral, etc may be used.

What is claimed is:

1. An image forming apparatus, comprising:

a fuser unit that heats a medium and fuses a developer on the medium;

first and second heating units that heat the fuser unit;

a temperature detection unit that detects a temperature of the fuser unit;

a heating control unit that stores a first setting temperature and a second setting temperature that is a lower temperature than the first setting temperature, and controls power that is supplied to the first heating unit and power that is supplied to the second heating unit, wherein the heating control unit controls the power supplied to the first heating unit based on the temperature detected by the temperature detection unit and the first setting temperature, and controls the power supplied to the second heating unit based on the temperature detected by the temperature detection unit and the second setting temperature, and one of the first and second heating units is always supplied with the power by the heating control unit while the fuser unit operates.

2. The image forming apparatus according to claim 1, further comprising:

a width setting unit that obtains and stores medium width information from a user, the medium width information indicating a width of the medium, wherein the control unit further stores a predetermined reference width, when the heating control unit determines that the medium width information is smaller than the reference width, the heating control unit controls the power supplied to the first heating unit based on the temperature detected by the temperature detection unit and the first setting temperature, and the power supplied to the second heating unit based on the temperature detected by the temperature detection unit and the second setting temperature, when the heating control unit determines that the medium width information is not smaller than the reference width, the heating control unit controls the power supplied to the second heating unit based on the temperature detected by the temperature detection unit and the first setting temperature, and the power supplied to the first heating unit based on the temperature detected by the temperature detection unit and the second setting temperature.

3. The image forming apparatus according to claim 2, wherein the distribution of the heating amount of the second heating unit is substantially consistent in a middle section of the width of the medium.

4. The image forming apparatus according to claim 1, wherein the heating control unit controls heating amounts of the first and second heating units by adjusting power supply time of the first and second heating units, the power supply time being defined as a period during which the heating control unit constitutes to supply the power.

5. The image forming apparatus of claim 1, wherein a printable temperature range in which the fuser unit is able to fuse the developer on the medium falls within 20 degrees inclusively.

6. The image forming apparatus of claim 1, wherein a difference between the first setting temperature and the second setting temperature is ranged between 5 degrees to 10 degrees inclusively.

7. The image forming apparatus according to claim 1, wherein the heating control unit controls the power supplied to the first heating unit by shutting the power off to the first heating unit when the temperature detected by the temperature detection unit is equal to or higher than the first setting temperature, and by supplying the power to the first heating unit when the temperature detected by the temperature detection unit is lower than the first setting temperature, and the heating control unit controls the power supplied to the second heating unit by shutting the power off to the second heating unit when the temperature detected by the temperature detection unit is equal to or higher than the second setting temperature, and by supplying the power to the second heating unit when the temperature detected by the temperature detection unit is lower than the second setting temperature.

8. The image forming apparatus according to claim 1, further comprising:

a pressure member that is disposed facing and contacting the fuser unit so that a nip part is created between the pressure member and the fuser unit, the medium being carried through the nip part, and a third heater unit that heats the pressure member, and another temperature detection unit that detects a temperature of the pressure member, wherein the heat control unit controls power that is supplied to the pressure member based on the temperature of the pressure member detected by the another temperature detection unit.

9. An image forming apparatus, comprising:

a fuser unit that heats a medium and fuses a developer on the medium;

first and second heating units that heat the fuser unit;

a temperature detection unit that detects a temperature of the fuser unit;

a heating control unit that stores a first setting temperature and a second setting temperature that is a lower temperature than the first setting temperature, and controls power that is supplied to the first heating unit and power that is supplied to the second heating unit, wherein the heating control unit controls the power supplied to the first heating unit based on the temperature detected by the temperature detection unit and the first setting temperature, and controls the power supplied to the second heating unit based on the temperature detected by the temperature detection unit and the second setting temperature, the first heating unit is set such that a heating amount of one end part in a direction perpendicular to a medium carrying direction is smaller than a heating amount of the other end, and a distribution of a heating amount of the second heating unit in the direction perpendicular to the medium carrying direction differs from a distribution of the heating amount of the first heating unit.

10. The image forming apparatus according to claim 9, further comprising:

a width setting unit that sets a width of the medium, wherein the heating control unit determines one of the first and second heating units depending on the width of the medium set by the width setting unit so that the power is supplied to the one of the first and second heating units.

11. The image forming apparatus according to claim 9, wherein, in a case where the width of the medium set by the width setting unit is equal to or wider than a reference value, the heating control unit heats the first heating unit when the temperature detected by the temperature detection unit is lower than the first setting temperature, and in a case where the width of the medium set by the width setting unit is narrower than the reference value, the heating control unit heats the second heating unit when the temperature detected by the temperature detection unit is lower than the second setting temperature.

12. The image forming apparatus according to claim 9, wherein the distribution of the heating amount of the second heating unit is substantially consistent in a middle section of the width of the medium.

13. The image forming apparatus according to claim 9, wherein the heating control unit controls heating amounts of the first and second heating units by adjusting power supply time of the first and second heating units, the power supply time being defined as a period during which the heating control unit constitutes to supply the power.

14. The image forming apparatus of claim 9, wherein a printable temperature range in which the fuser unit is able to fuse the developer on the medium falls within 20 degrees inclusively.

15. The image forming apparatus of claim 9, wherein a difference between the first setting temperature and the second setting temperature is ranged between 5 degrees to 10 degrees inclusively.

16. The image forming apparatus according to claim 9, wherein the heating control unit controls the power supplied to the first heating unit by shutting the power off to the first heating unit when the temperature detected by the temperature detection unit is equal to or higher than the first setting temperature, and by supplying the power to the first heating unit when the temperature detected by the temperature detection unit is lower than the first setting temperature, and the heating control unit controls the power supplied to the second heating unit by shutting the power off to the second heating unit when the temperature detected by the temperature detection unit is equal to or higher than the second setting temperature, and by supplying the power to the second heating unit when the temperature detected by the temperature detection unit is lower than the second setting temperature.

17. The image forming apparatus according to claim 9, further comprising:

a pressure member that is disposed facing and contacting the fuser unit so that a nip part is created between the pressure member and the fuser unit, the medium being carried through the nip part, and a third heater unit that heats the pressure member, and another temperature detection unit that detects a temperature of the pressure member, wherein the heat control unit controls power that is supplied to the pressure member based on the temperature of the pressure member detected by the another temperature detection unit.

18. The image forming apparatus according to claim 9, further comprising:

a width setting unit that obtains and stores medium width information from a user, the medium width information indicating a width of the medium, wherein the control unit further stores a predetermined reference width, when the heating control unit determines that the medium width information is smaller than the reference width, the heating control unit controls the power supplied to the first heating unit based on the temperature detected by the temperature detection unit and the first setting temperature, and the power supplied to the second heating unit based on the temperature detected by the temperature detection unit and the second setting temperature, when the heating control unit determines that the medium width information is not smaller than the reference width, the heating control unit controls the power supplied to the second heating unit based on the temperature detected by the temperature detection unit and the first setting temperature, and the power supplied to the first heating unit based on the temperature detected by the temperature detection unit and the second setting temperature.

19. The image forming apparatus according to claim 18, wherein the distribution of the heating amount of the second heating unit is substantially consistent in a middle section of the width of the medium.

* * * * *